United States Patent [19]

Vella

[11] 4,051,871

[45] Oct. 4, 1977

[54] ELECTRONIC DEVICE FOR CONTROLLING WEFT YARN INSERTION IN LOOMS

[75] Inventor: Sergio Vella, Biella (Vercelli), Italy

[73] Assignee: ROJ Electrotex S.p.A., Biella (Vercelli), Italy

[21] Appl. No.: 573,003

[22] Filed: Apr. 30, 1975

[30] Foreign Application Priority Data

Apr. 30, 1974 Italy ..... 22117/74

[51] Int. Cl.[2] ..... D03D 51/34

[52] U.S. Cl. ..... 139/370.2

[58] Field of Search ..... 139/370 A, 370 C, 371, 139/122 W, 336, 370.1, 370.2; 66/163; 57/81; 28/51; 340/259

[56] References Cited

U.S. PATENT DOCUMENTS

| | | | |
|---|---|---|---|
| 3,526,254 | 9/1970 | Schmitz | 139/370 A |
| 3,528,460 | 9/1970 | Spearman | 139/370 A |
| 3,688,958 | 9/1972 | Rydborn | 139/370 A |
| 3,802,468 | 4/1974 | Meyer et al. | 139/370 A |
| 3,863,241 | 1/1975 | Kamiyamaguchi et al. | 139/370 A |
| 3,911,969 | 10/1975 | Rydborn | 139/370.1 |

FOREIGN PATENT DOCUMENTS

| | | | |
|---|---|---|---|
| 335,315 | 4/1972 | U.S.S.R. | 139/370 A |

*Primary Examiner*—James Kee Chi

*Attorney, Agent, or Firm*—Young & Thompson

[57] ABSTRACT

Electronic device for controlling weft yarn insertion in continuous weft feed looms, without shuttles, adapted to stop the loom and emit a corresponding signal, not only each time there is a breakage or absence of a weft yarn, but also whenever the undesired insertion of double wefts occurs. This device comprises a plurality of transducers, each activated by a weft yarn, a logic network and means for stopping the loom, said logic network comprising means for storing a predetermined law of insertion of the individual weft yarns corresponding to a certain weaving operation on the loom, and for comparing with said law the actual weft insertions detected by the transducers.

6 Claims, 2 Drawing Figures

ELECTRONIC DEVICE FOR CONTROLLING WEFT YARN INSERTION IN LOOMS

BACKGROUND OF THE INVENTION

This invention relates to a device for controlling weft yarn insertion, or a warp stop motion device, for use in continuous weft feed looms, without shuttles.

The purpose of the device according to the invention is to stop the loom and emit a corresponding signal, not only each time there is a breakage or absence of a weft yarn — which is already efficiently obtained by various known devices — but also whenever the undesired insertion of double wefts occurs.

It is known that, in loom operation, the weft yarn often breaks or is missing, and, to overcome this phenomenon, warp stop motion devices are used for controlling the breakage of the weft thread, in various universally known mechanical, electrical or electronic versions. It can however also happen that, especially with hairy yarn, the weft yarn presented to the gripper of a shuttleless loom takes along with it another weft yarn, which is thus simulaneously inserted, with serious damage to the fabric. This phenomenon is favoured by the fact that the weft yarns ready to be inserted are subjected to very low stretching and, thus, the action of the yarn fluff is sufficient to hook two yarns together.

It can also happen that the perforated tape, controlling weft insertion by means of the presenting device, may get damaged, in which case, one or more wrong wefts will be presented to the gripper in addition to the required weft yarn. In this case, as the perforated tape is generally in the form of an endless loop, the error becomes cyclic with serious damage to the fabric.

The invention relates therefore to an electronic control device being adapted, at each weft insertion, to check the number of wefts being inserted or the possible breakage of the wefts, and to immediately stop the loom — in the event or irregularities — in sufficient time to repair the damage, hence representing considerable progress over the known art.

SUMMARY OF THE INVENTION

This device is substantially characterized in that it comprises a plurality of transducers, each activated by a weft yarn and being adapted to feed signals to a logic network when the yarn is in movement, and means, downstream of said logic network, operated by the signals emitted by said network and adapted to activate a device for stopping the loom and providing a signal, said logic network comprising means for storing a predetermined law of insertion of the individual weft yarns corresponding to a certain weaving operation on the loom, and for comparing with said law the actual weft insertions detected by the transducers. In the logic network, the means for storing and comparing preferably consist of a voltage divider, comprising on one side a plurality of resistors, one for each transducer, disposed in parallel, and on the other side, a single comparison resistor, so as to obtain an output signal which is above or, respectively, below a normal predetermined value, when the actual weft yarn insertions detected by the transducer do not coincide with those required, or, respectively when there is no weft yarn insertion. Furthermore, each of said resistors as well as the comparison resistor of the voltage divider, comprise a first stably connected resistor and a second resistor, equal to the first and adapted to be connected thereto by means of a switch, adapted to be manually operated during programming of the weft yarn insertion law, corresponding to the weaving operation to be performed on the loom. To make it at once evident to the operator whether the stopping of the loom is due to breakage of a weft yarn or to the insertion of too many weft yarns, the device for stopping the loom and providing a signal fulfills this last purpose by lighting a lamp, either continuously or intermittently, according to which of said irregularities is responsible for activating the device.

BRIEF DESCRIPTION OF THE DRAWINGS

The invention will now be described in further detail, to illustrate more fully its characteristics and advantages, with reference to one embodiment thereof given by way of example and illustrated in the accompanying drawings, in which.

DESCRIPTION OF THE PREFERRED EMBODIMENT

Figure 1:
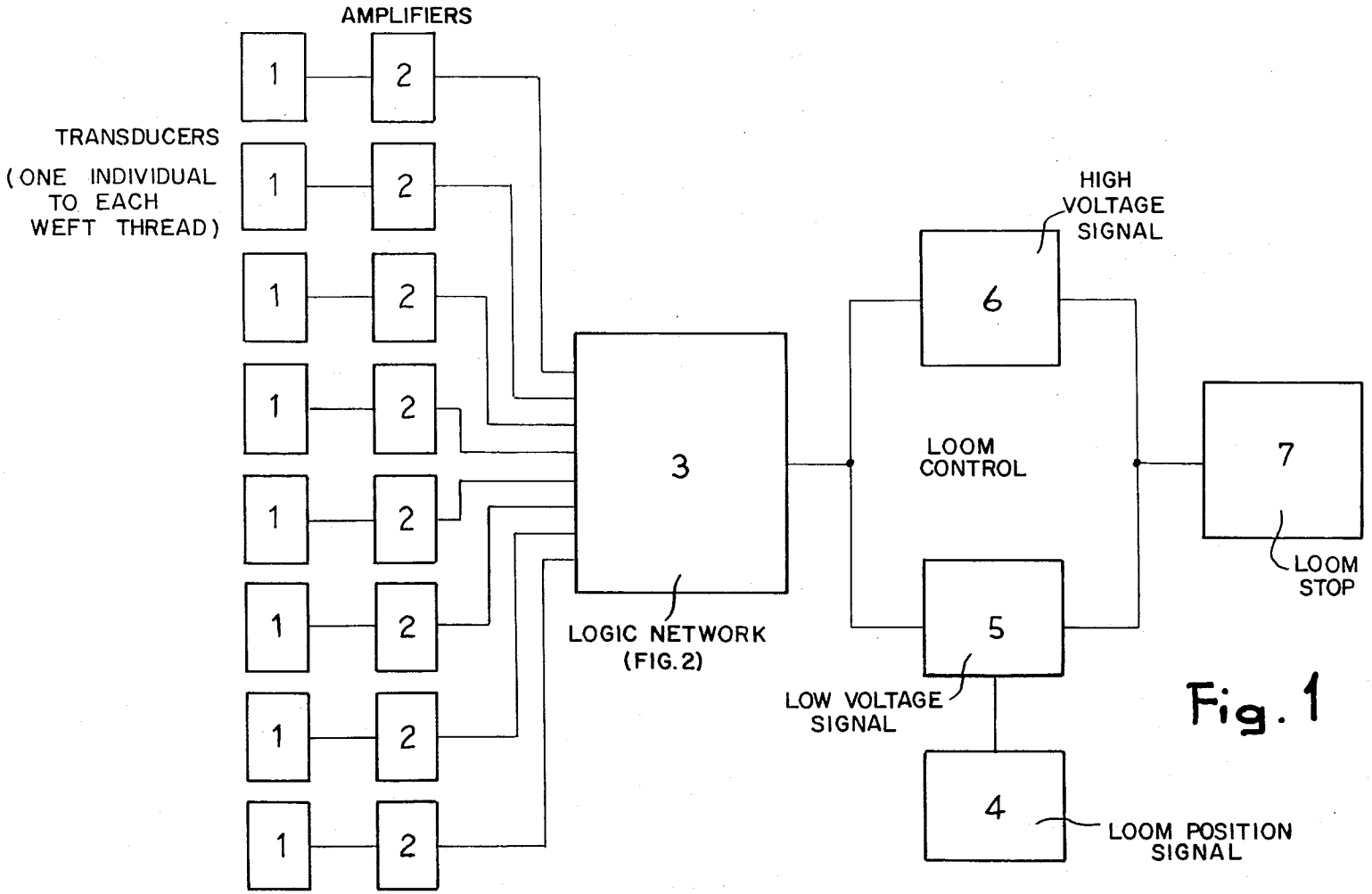
FIG. 1 is a block diagram of the warp stop motion device according to the invention.
Figure 2:
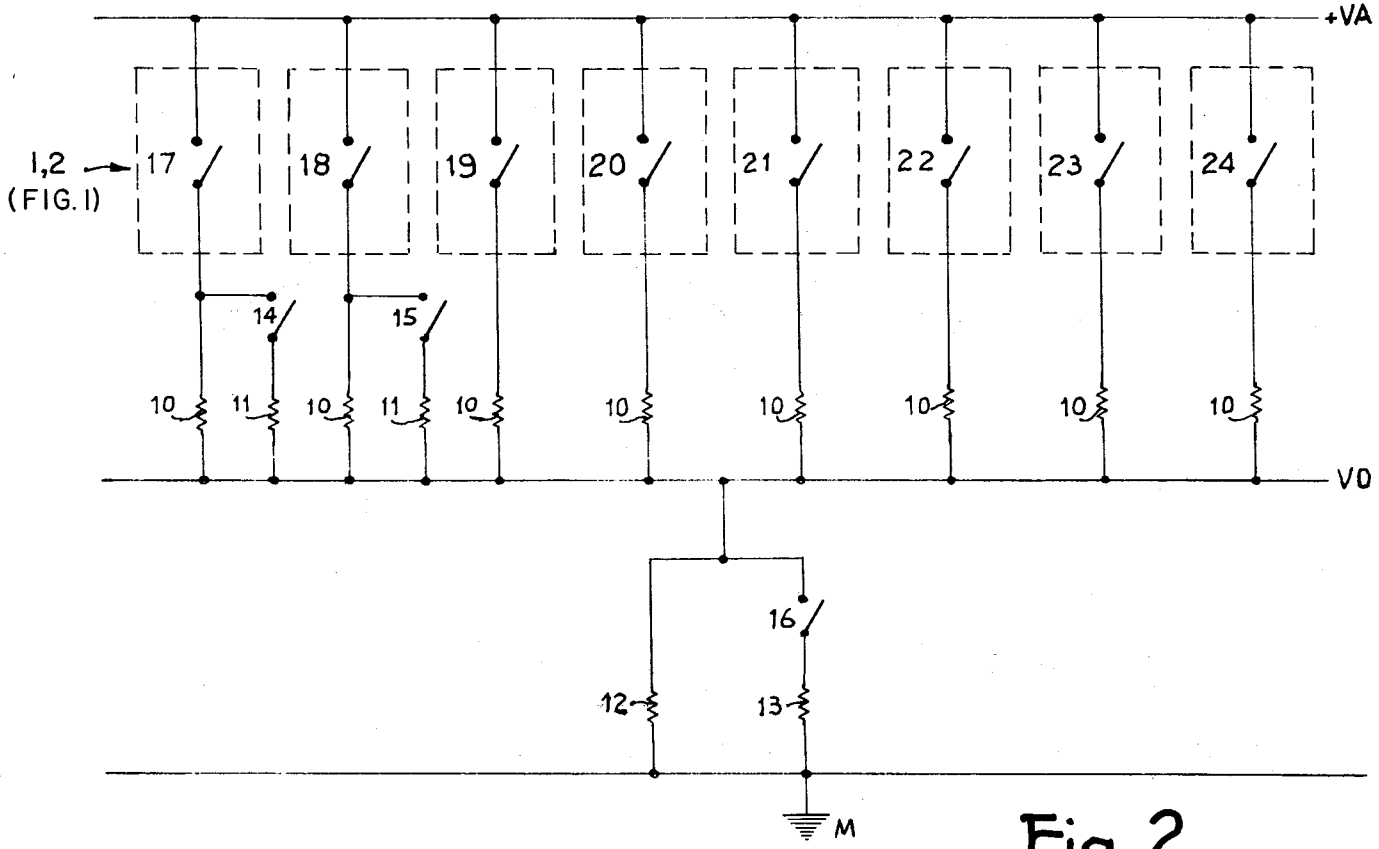
FIG. 2 represents the logic network used in the device according to the illustrated embodiment.

With reference to the drawings, FIG. 1 shows that the device according to the present invention comprises a certain number (eight in the drawing) of systems, adapted to detect the movement of the weft yarns by means of transducers, which supply an electric output signal. Said transducers may base their operation on photoelectric, electromagnetic, piezoelectric or condenser principles, according to the prechosen embodiment. Use of the piezoelectric crystals principle may however be recommended. In this case, the weft yarn skims a ceramic tube, to which a plate of piezoelectric material is mechanically fixed. The movement of the yarn sliding on the ceramic tube produces a noise which is transformed into an electric signal by the piezoelectric lamina. There are as many transducers 1 as there are weft yarns to be controlled (a maximum of eight in the case of normal gripper looms, as indicated). In the device according to the invention, an amplifier 2 is associated to each transducer 1, said amplifier being fed by the signals originating from the transducer and adapted to amplify, rectify and integrate said signals. The transducers 1 and amplifiers 2 must possess specific characteristics subject to very strict requirements, as is explained in greater detail hereinafter; the signals which they produce and elaborate arrive at a programmable logic network 3, the purpose of which is to compare the input signals, representing the actual weft yarn insertions detected by the transducers with the predetermined insertion law stored in the network itself, and to supply a direct current output signal, the value of which will vary from the normal predetermined value in the event of irregularities, and said value being different according to whether the weft yarn is broken or whether too many weft yarns have been inserted. This logic network, which may be constructed in various ways, by means of analogic or digital electronic systems, is shown in FIG. 2 in one of its preferred versions, and is described in detail hereinafter. The output from the logic network 3 is connected to two blocks 5 and 6 which, by means of a further block 7, control the stopping of the loom and the continuous or intermittent lighting of a warning lamp. The block 6 acts independently, while the block 5 is adapted to operate only upon receipt of a gate signal from a further block 4, controlled by the general movement of the loom by way of a cam.

The logic network 3, shown in FIG. 2, consists of a voltage divider. In said network, the reference numbers 17 to 24 indicate the eight electronic switches each formed by a unit comprising an associated set of elements 1 and 2 as seen in Fig. 1; these switches are open when the respective weft yarn is at rest and are closed when said yarn is inserted into the warp.

The reference +VA indicates the supply voltage of the voltage divider common to all switches 17 to 24, and VO indicates the output signal of the block 3, being drawn through a common connection to which each of the switches 17 to 24 is connected through a respective resistor 10. The said common connection is also constantly connected to earth at M through a resistor 12. Resistors 11 may be connected in parallel to the resistors 10 by closing the switches 14, 15 (shown open), while a resistor 13 may be similarly connected in parallel to the resistance 12 by closing a switch 16 (also illustrated open). The resistors 10 and 11 have the same value; also the resistors 12 and 13 have the same value. The resistors 11 are shown only in correspondence of the electronic switches 17 and 18, but they could also be provided for any other of the switches 19 to 24.

A brief description will now be given of the operation of the device, the basic scheme of which has been described.

A first case is that in which the loom operates in such a manner that all the wefts are inserted individually. In this case the programming of the network 3 consists of setting all switches 14, 15, 16 in the open position. In this condition, if a single weft is inserted at a time, with the loom operating regularly, the particular electronic switch of the series 17 to 24, corresponding to the particular weft being inserted, closes its circuit. VA is then divided between 10 and 12 to give an output VO, the value of which depends on VA and on the resistors 10 and 12; whereby, whichever the weft yarn in movement, the output VO is the same (in one practical embodiment, to which reference will be made hereinafter, this will be 1 volt). If, instead, at a certain moment one of the wefts breaks, all the electronic switches 17 to 24 remain open and VO thus becomes equal to zero. It can however happen that two weft yarns are inserted simultaneously by mistake. In this case, two of the electronic switches 17 to 24 close simultaneously. Under these conditions, VA is divided between two parallel resistors 10 on one side and the resistor 12 on the other, and the voltage VO increases with respect to its normal value (and becomes for example 2 volts). In conclusion, if the loom operates by inserting the wefts individually, a signal is supplied by the network 3 to the blocks 5, 6, which, in the example given, is of 1 volt if loom operation is normal, of 0 volt if a weft breaks, and of 2 volts if there is double weft insertion.

A second case is that in which the loom operates on complete double weft insertion. In this case, for the programming, the switch 16 of the network 3 is closed, so as to cause two parallel resistors 10, 10, on one side of the voltage divider (always connected for the normal simultaneous operation of two of the switches 17 to 24) to correspond to two resistors 12, 13 on the other side. If loom operation is regular, and the wefts are inserted in pairs as scheduled, the voltage VA is divided, as in the previous case, between the pairs of resistors, whereby VO is always the same (and is thus again of 1 volt, referring to the previous example). If, instead, one of the two weft threads to be simultaneously inserted breaks, the network is thrown out of balance by the opening of one of the switches 17 to 24 and by the exclusion of the corresponding resistor 10. The voltage VO halves (and will thus be 0.5 volt, in the example). If on the contrary, there is simultaneous insertion of more than two wefts, the network 3 is thrown out of balance in the opposite direction to the previous one (and VO will thus be equal to 1.5 volts, in the case of the example given). Breakage of both weft yarns to be inserted could also occur, in which case VO would be equal to zero.

The device is also adapted to intervene in a third case, namely when weaving with some double weft yarn insertions and some single weft yarn insertions. In this case the control must be selective. The network represents the case in which the electronic switches 17 and 18 control two single wefts, and the switches 19 to 24 (six in all) control three double wefts, each weft yarn being evidently controlled by one transducer 1 (FIG. 1). In this case, to program the network 3, the switches 14, 15 and 16 are closed. If loom operation is regular, upon insertion of the double wefts, two of the switches 19 to 24 close and the voltage VA divides between pairs of resistors 10 and pairs of resistors 12, 13 (whereby in the given example, VO equals to 1 volt). Likewise, upon insertion of the single wefts, the switch 17 or 18 closes and the voltage VA divides, as above, between the resistors 10, 11 and the resistors 12, 13 (VO = 1 volt). If one of the single wefts, or both the yarns of one of the double wefts break, the switches 17 to 24 are all opened and VO equals to 0. If, instead, one of the yarns of the double wefts breaks, only one of the switches 19 to 24 closes; the voltage divides between one resistors 10 on one side and the pair of resistors 12, 13 on the other, and the network 3 is thrown out of balance (VO = 0.5 volt, in the example). If a double weft is inserted instead of a single weft, the switches 17 and 18 close simultaneously and the voltage VA is divided between two pairs of resistors 10, 11 and one pair of resistors 12, 13 respectively; the network 3 is thrown out of balance (and the voltage VO = 2 volts, in the example given). Finally, two pairs of double weft yarns may be inserted simultaneously, or one pair of double weft yarns and one single weft yarn. In this case, either two pairs of switches 19 to 24 or one of the switches 17, 18 and one pair of the switches 19 to 24 are closed. Under these conditions, the network 3 is thrown out of balance as previously (VO = 2 volts, as above).

By comparing the values of VO, obtained in the various situations in the wide set of examples examined, it can be seen that there is always a certain value of VO corresponding to normal loom operation (VO = 1 volt in the chosen example), a value of VO below the normal value (0.5 volt, for example) or equal to zero, in the case of breakage of one or more weft yarns, and a value of VO above the normal value (VO = 1.5 or VO = 2 volts, in the example) in the case of too many wefts being inserted.

In view of this, it is quite easy to follow the operation of that part of the device downstream of the network 3. When the output signal from the network 3 is that corresponding to normal operation (VO = 1 volt) neither the block 5, which is adapted to emit signals when receiving signals of smaller voltage, nor the block 6, which is adapted to emit signals when receiving signals at higher voltages, operate. When the output signal from the network 3 is less than the normal value (VO = 0.5 volt or VO = 0) the block 4 comes into operation;

this, however, has to give an output signal only when the loom gripper has almost completely traversed the entire length of the warp, since the checking on the integrity of the weft yarns should evidently be made only during this particular stage on the loom movement (in this respect, there is normally one stage in the cycle in which the wefts are at rest, and if the control device were activated at this time, the loom would be stopped without reason). This is obtained by means of the gate device 4 which is controlled by a cam which is integral with the loom movement. When the block 4 gives its gate signal, the block 5 operates the block 7, which stops the loom and lights an indicator lamp with a continuous light (broken yarn). If, however, the output signal from the network 3 is higher than the normal value (VO = 1.5 or VO = 2 volts), the block 6 comes into operation. In this case, no gate signal is required, since normally, the voltage level cannot be higher than the normal value at any stage in the cycle (wefts at rest or wefts in movement).

The block 6 operates in turn, again through the block 7, the stopping of the loom and the intermittent lighting of the indicator lamp (double insertion).

In this manner, while the loom stops each time there is an irregularity in operation, the operator has an immediate indication of the type of irregularity which has occurred and may rapidly restore the loom to working condition.

Because of the possibility to program the operation of the device described, by simply operating the switches in the logic network, it is evident that said device has a latitude of intervention which is exceptionally wide, or even complete, in that none of the irregularities which may occur in feeding the weft yarns to any type of loom and in any type of weaving operation, can escape its control.

The result is evidently of utmost importance and represents a great improvement over any known device of this type. The practical construction of the device obviously requires particular care. From experiments made so far it has been found, for example, that the transducers must be able to detect also the movement of fine, smooth and regular yarns producing only a very small or negligible tension on the yarn, and this because in gripper looms, the weft yarn must have maximum freedom of movement and must therefore not undergo any external stress. On the other hand, the transducers must also provide a high signal/disturbance ratio, which is not objectively simple in machines such as looms which are subject to very strong vibrations and noise.

There must further be high mechanical insulation to vibrations between one transducer and another, so that the vibrations induced into one transducer, by the movement over it of a yarn with large irregularities, are not transmitted to the adjacent transducers, and a proper choice of time constants must be made in order to obtain a certain lag in the control of the electronic switches in relation to yarn breakage (about 4 to 6 milliseconds).

In the practical embodiment of the device, the possibility has been tried of locating the blocks 1, 2 and 3 of the device in a single small-size container. The unit thus constructed may be electrically connected to the main panel of the loom by only three wires, with obvious simplicity of application.

The figures of the drawings and the description given heretofore refer only to one embodiment of the invention, given by way of non-limiting example. Other embodiments and various modifications of the one illustrated are however possible, as will be evident to those skilled in the art, without thereby departing from the scope of the present invention.

I claim:

1. Electronic device for controlling weft yarn insertion in continuous weft feed looms, designed to stop the running of the loom and to provide a signal, whenever there is either breakage of a weft yarn or when a larger number of weft yarns than that scheduled, is inserted by mistake, characterized in that it comprises a plurality of transducers each activated by movement of a weft yarn and adapted to feed signals to a logic network when the yarn is in movement, there being a said transducer individual to each said weft yarn and means, downstream of said logic network, operated by the signals emitted by said network and adapted to activate a device for stopping the loom and providing a signal, said logic network comprising means for storing a predetermined law of insertion of the individual weft yarns corresponding to a certain weaving operation on the loom, and for comparing with said law the actual weft insertions detected by the transducers thereby to stop the loom not only when fewer than a predetermined number of weft yarns is inserted in the loom but also when more than said predetermined number of yarns is inserted in the loom.

2. Device as claimed in claim 1, wherein the signals produced by the transducers, when the weft yarns are in movement, are fed to said logic network by amplifying, rectifying and integrating means, one for each transducer.

3. Device as claimed in claim 1, wherein the storage and comparison means in said logic network consist of a voltage divider comprising on the one side, a plurality of resistors, one for each transducer, disposed in parallel, and on the other side, a single comparison resistor, so as to obtain an output signal which is above or, respectively, below a normal predetermined value, when the actual weft yarn insertions detected by the transducers do not coincide with those required or, respectively, when there is no weft yarn insertion.

4. Device as claimed in claim 1, wherein said means dowstream of the logic network comprise two electronic circuits adapted to emit signals, one of said circuits emitting signals only upon receipt from said network of a signal being above its normal predetermined value, and the other of said circuits emitting signals only upon receipt from said network of a signal being below its normal predetermined value, and means responsive to a signal from either of said circuits to stop the loom.

5. Device as claimed in claim 4, wherein the electronic circuit, which is adapted to emit signals only upon receipt from the logic network of a signal below its normal value, is conditioned by a gate device which is controlled by the general loom movement.

6. Device as claimed in claim 3, wherein the resistors of said plurality of resistors of the voltage divider forming the logic network, each comprise a first stably connected resistor and a second resistor of same value as the first and adapted to be connected in parallel thereto by means of a switch, which can be operated manually during programming of the weft yarns insertion law corresponding to the weaving operation to be carried out on the loom, while said comparison resistor of the voltage divider forming the logic network, comprises a first stably connected resistor and a second resistor of same value as the first and adapted to be connected thereto by means of a switch, which can be operated manually during programming of the weft yarns insertion law corresponding to the weaving operation to be carried out on the loom.

* * * * *